US007665455B2

(12) United States Patent
Salva

(10) Patent No.: US 7,665,455 B2
(45) Date of Patent: Feb. 23, 2010

(54) COMPRESSED GAS OPERATED PISTOL

(75) Inventor: Francisco Casas Salva, Sant Boi De Llobregat (ES)

(73) Assignee: Industrias el Gamo, SA, Saint Boi De Llobregat (ES)

( * ) Notice: Subject to any disclaimer, the term of this patent is extended or adjusted under 35 U.S.C. 154(b) by 43 days.

(21) Appl. No.: 11/884,439

(22) PCT Filed: Mar. 1, 2006

(86) PCT No.: PCT/IB2006/000426

§ 371 (c)(1),
(2), (4) Date: Jun. 24, 2008

(87) PCT Pub. No.: WO2006/092706

PCT Pub. Date: Sep. 8, 2006

(65) Prior Publication Data

US 2008/0276921 A1 Nov. 13, 2008

(30) Foreign Application Priority Data

Mar. 2, 2005 (ES) ..... 200500477

(51) Int. Cl.
*F41B 11/00* (2006.01)

(52) U.S. Cl. ..... 124/74

(58) Field of Classification Search ..... 124/71–74; 42/70.06

See application file for complete search history.

(56) References Cited

U.S. PATENT DOCUMENTS

| | | | | |
|---|---|---|---|---|
| 3,069,976 A | 12/1963 | Stevens, Jr. | | |
| 4,003,293 A * | 1/1977 | Uria et al. | ..... | 89/198 |
| 5,884,615 A * | 3/1999 | Casas Salva | ..... | 124/71 |
| 6,578,565 B2 * | 6/2003 | Casas Salva | ..... | 124/73 |
| 2004/0200466 A1 * | 10/2004 | Salva | ..... | 124/74 |

FOREIGN PATENT DOCUMENTS

| | | |
|---|---|---|
| EP | 0356884 | 3/1990 |
| EP | 0239544 | 11/1990 |
| EP | 0307156 | 6/1992 |
| EP | 0844456 | 9/2000 |
| EP | 1184639 | 3/2002 |
| FR | 2847665 A1 * | 5/2004 |
| WO | 2004/104507 | 12/2004 |

* cited by examiner

*Primary Examiner*—Troy Chambers
(74) *Attorney, Agent, or Firm*—Townsend and Townsend and Crew LLP

(57) ABSTRACT

The trigger safety mechanism is a pivoted element (102) in which lower part there is a shaped fork (103) through of which linear guide (106) there is a guidance means (104); in which upper part there is an articulated transmission rod (101) that is supported by its other end on the hammer, being a separation space (100) between the hammer (6) and the operation end of the valve (12*a*) when the trigger (5) is in resting position; and in a point of the surface of the pivoted element (102) there is a rotation axis (107); so that when the trigger is moved to an active position, the guidance means passes through the interior of the linear guide so that the said pivoted element drags the rod, allowing the hammer (6) to impact the valve.

3 Claims, 2 Drawing Sheets

COMPRESSED GAS OPERATED PISTOL

Improvements on the subject of the Spanish Patent n. 200202704 for compressed gas operated pistol, of the type that comprise a support casing that defines: a barrel zone that contains a barrel with a rear end facing the chamber, being said barrel able to move and is guided linearly to cause a movement of a rocker in an axial direction; in the trigger zone there is a trigger connected to a trigger safety mechanism and in the stock zone there is an ammunition magazine arranged to insert and retain the pellet into said chamber prior to each shot, and a pressurised gas cylinder connected with a valve chamber which, in turn, is connected to said chamber via a valve element pushed by elastic means towards a closed position. Said valve element can be instantly moved to an open position by impact from said hammer; characterized in that said trigger safety mechanism consist of a pivoted element: in which lower part there is a shaped fork which is slightly inclined in relation to the horizontal, through of which linear guide, in the interior of said fork there is a guidance means linked to the trigger, in which upper part there is an articulated transmission rod that is supported by its other end on the hammer, being a separation space between the hammer and the operation end of the valve when the trigger is in resting position, and in a point of the surface of the pivoted element there is a rotation axis of said pivoted element to the body of the pistol, so that when the trigger is moved to an active position, the guidance means passes through the interior of the linear guide causing the rotation and rocker movement of said pivoted element by means of its rotation axis, so that the said pivoted element drags the rod in the opposite direction to the movement of the trigger allowing the hammer to impact the valve.

BACKGROUNDS OF THE INVENTION

It is known in the state of the art different patents that include safety systems to prevent the accidental firing of the pistol.

Thus, it is known the European Patent n°0239544 (ES 2018699) of the year 1987, in the name of the Italian company FABBRICA D'ARMI P. BERETTA S. P. A., that refers to a safety device for an automatic pistol of the double action type that includes an automatic safety on the firing pin and has a striking lever for the hammer. The device comprises a cammed shaft, rotatably mounted to a carriage of the pistol and displaceable manually in one direction for control of the lever for disengagement of the hammer. The cammed shaft is rotatable in an opposite direction by means of a spring loaded piston for blocking the shaft in a rest position where it does not interfere with firing of the pistol.

It is also known the European Patent n°0356884 (ES 2018131) of the year 1989, in the name of the Swiss company ITM INDUSTRIAL TECHNOLOGY & MACHINES AG, that refers to a locking plunger which is perpendicular movable relative to the direction of movement of the firing pin that allows or prevents the axial movement of the firing pin to fire the gun. This locking plunger is spring biased to abut a safety lever which is part of the sear of the operating members of the gun. The safety lever is located and arranged such on the sear that it allows a movement of the locking plunger into the firing pin unlocking position upon the operating members of the gun reaching the end of the trigger slack. Accordingly, a movement of the locking plunger into the unlocking position will proceed not earlier than the sear snapping into the firing position. Any other accidental limited movements of the operating parts of the gun including such of the hammer cannot cause an axial movement of the firing pin because such movement is positively prevented by the locking plunger. Therefore, an accidental firing of the gun is positively prevented.

Finally, it is also known the European Patent n°0307156 (ES 2034251) of the year 1988, in the name of the British company VICTORY ARMS CO. LIMITED, that refers to a self loading firearm of the locked breech, short recoil pistol type has a barrel and a breech block slide provided With a separate locking block accommodated between the underside of the barrel and the upper surface of a movable trigger guard. The locking block is provided with means for positively locking the barrel to the slide during the high pressure period of the firing cycle of the firearm and means for enabling release of the slide from the barrel during the remainder of the firing cycle. Means described for permitting release of the locking block comprise a rotary catch which is rotatable between a position to hold the locking block in its barrel retaining position and a position in which the locking block is able to release the barrel. The rotary catch is movable axially between a position in which it is rotatable and a position in which it is non-rotatable, the locking block normally being held in its non-rotatable position by the hold open means and being released from that position when the hold open means is in its operative position to hold the slide fully retracted from its forward firing position.

BRIEF DESCRIPTION OF THE INVENTION

It has been noted in the use of the present pistol that could be increased the dependability and the simplicity of the structure of the pistol performing with a new design the kinematic device that affects the operation of the hammer and its impact in the valve of the container that contains the propellant gas.

Therefore, the improvements object of the present invention, consist of the design of the said kinematic device of the trigger mechanism and concern to the safety system of the pistol relating to the resting position, that is, the non-use of the pistol, and to the operation position, that is, the firing of the same.

It is an object of the present invention a compressed gas operated pistol, of the type that comprise a support casing that defines: a barrel zone that contains a barrel with a rear end facing the chamber, being said barrel able to move and is guided linearly to cause a movement of a rocker in an axial direction; in the trigger zone there is a trigger connected to a trigger safety mechanism and in the stock zone there is an ammunition magazine arranged to insert and retain the pellet into said chamber prior to each shot, and a pressurised gas cylinder connected with a valve chamber which, in turn, is connected to said chamber via a valve element pushed by elastic means towards a closed position. Said valve element can be instantly moved to an open position by impact from said hammer; characterized in that said trigger safety mechanism consist of a pivoted element: in which lower part there is a shaped fork which is slightly inclined in relation to the horizontal, through of which linear guide, in the interior of said fork there is a guidance means linked to the trigger, in which upper part there is an articulated transmission rod that is supported by its other end on the hammer, being a separation space between the hammer and the operation end of the valve when the trigger is in resting position, and in a point of the surface of the pivoted element there is a rotation axis of said pivoted element to the body of the pistol, so that when the trigger is moved to an active position, the guidance means passes through the interior of the linear guide causing the rotation and rocker movement of said pivoted element by means of its rotation axis, so that the said pivoted element drags the rod in the opposite direction to the movement of the trigger allowing the hammer to impact the valve.

In this way, even if the pistol falls to the ground there is not risk of the accidental firing of the same, since the rod prevents the hammer to impact the valve. In fact, until the moment that the trigger is completely displaced, the rod is not released, and until that moment the hammer can not get closer to the valve to later impact on it.

To facilitate the explanation are attached to the present description a drawings in which a case of an embodiment of improvements on the subject of the Spanish Patent n. 200202704 has been reproduced, which is mentioned only for exemplificative, non limitative of the scope of the claims.

BRIEF DESCRIPTION OF THE DRAWINGS

With the purpose to facilitate the explanation two sheets of drawings are attached to the present description, in which a practical case of an embodiment has been reproduced, which is mentioned only for exemplificative, non limitative of the scope of the present invention.

PREFERRED EMBODIMENT OF THE PATENT APPLICATION

With the intention to facilitate the understanding have been used the same numbers of the base patent adding those relating to the new elements from 100 which are not included in the said base patent.

Figure 1:
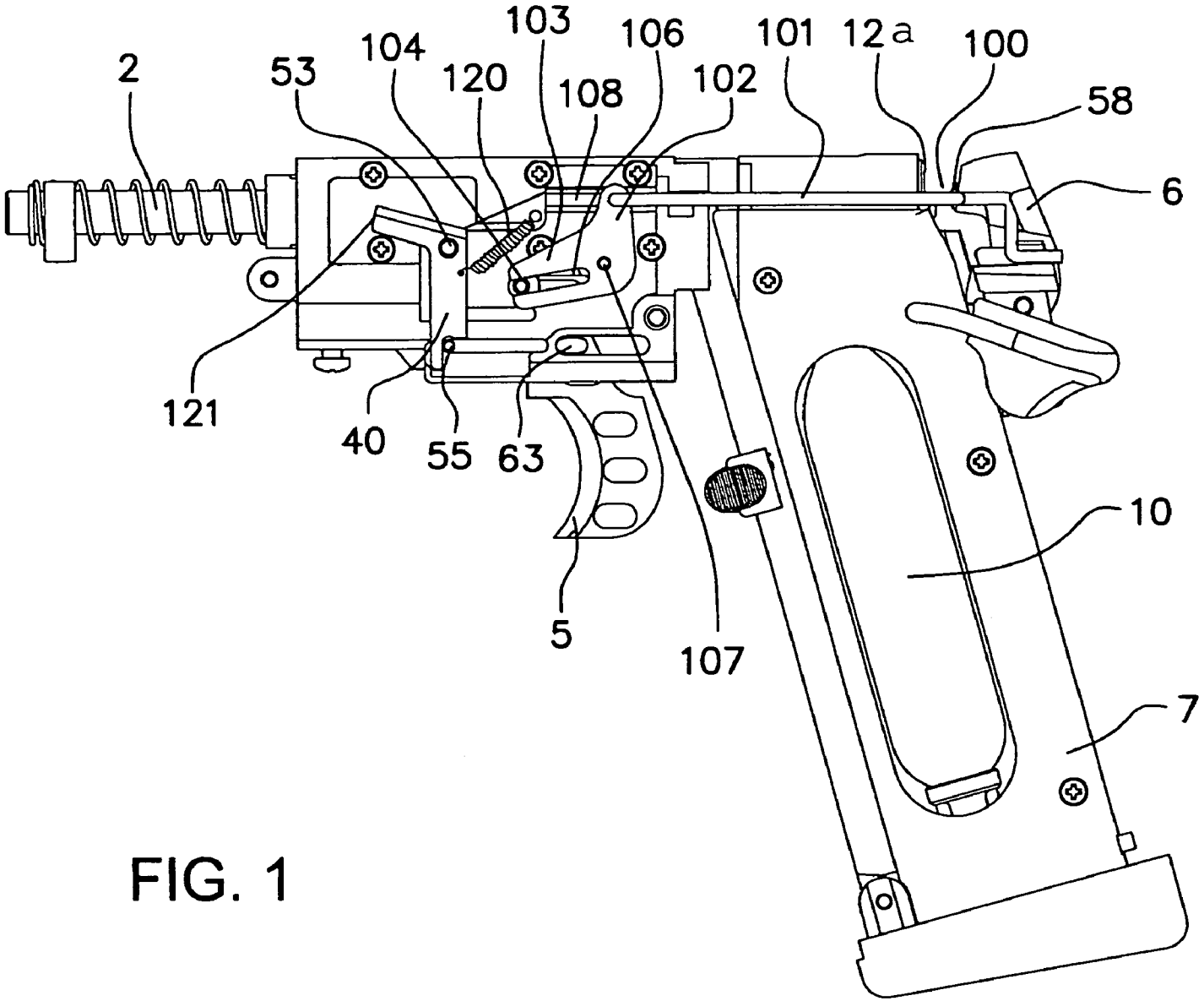
FIG. 1 is a view of the pistol according to the patent, viewed in the resting or non-operational position.

Thus, in the FIG. 1 is shown a barrel 2, a trigger 5, a hammer 6, a stock zone 7, a pressurised gas cylinder 10, an operating end 12*a* of the valve, an arm 40 with its end 121, an axis 53, a spring 120, a snug 55 joined to the trigger, a stud 58, a protuberance 63, a separation space 100 between the stud 58 and the operating end 12*a*, a rod 101, a pivoted element 102, a fork 103, a linear guide 106, a rotation axis 107 and a guidance means or a catch 104.

Figure 2:
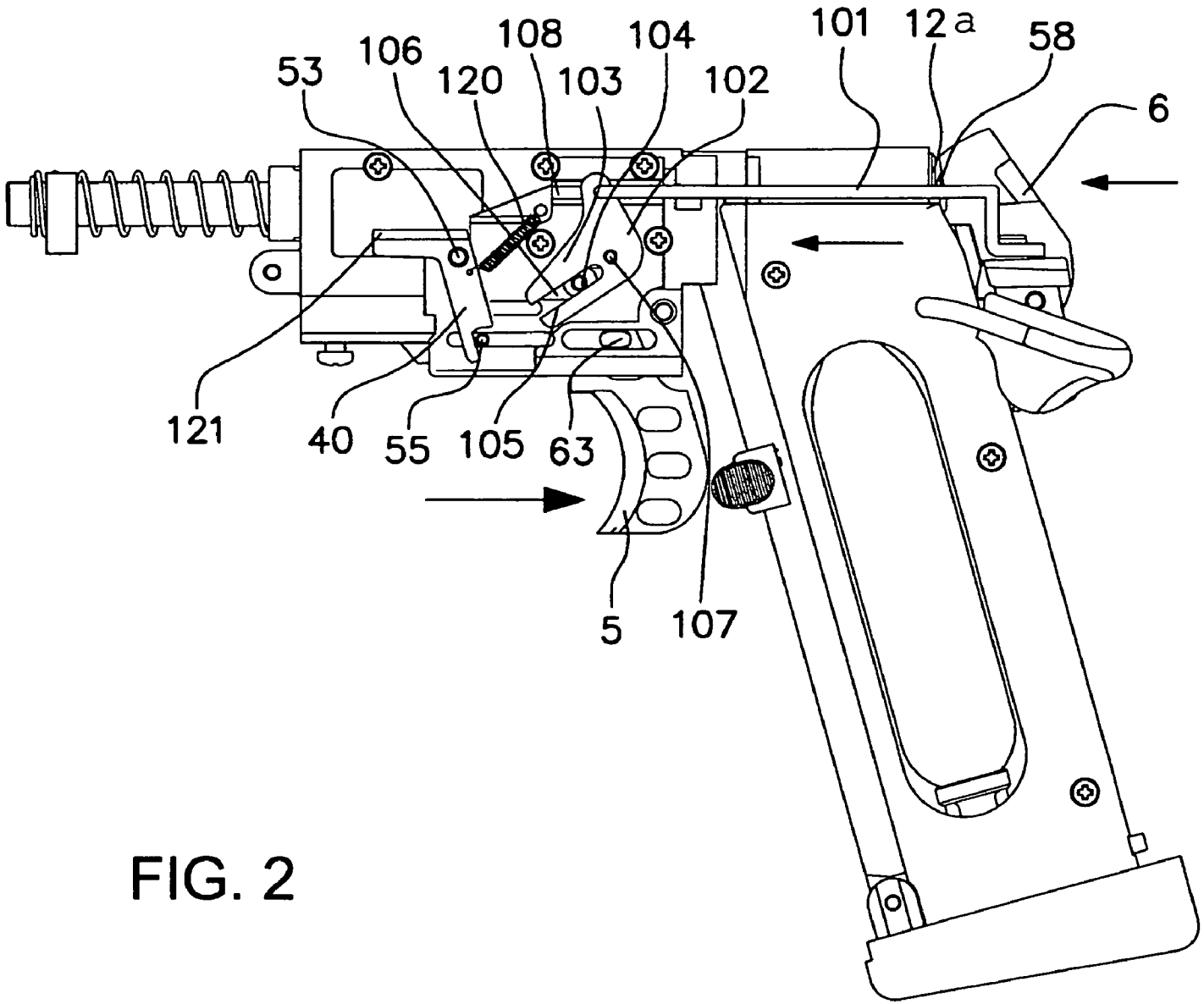
FIG. 2 is a view of the same pistol in the firing position.

In the FIG. 2 there is shown the said trigger 5, the hammer 6, the operating end 12*a* of the valve, the arm 40 with its end 121, the axis 53, the spring 120, the snug 55 joined to the trigger, the stud 58, the protuberance 63, the rod 101, the pivoted element 102, the fork 103, the linear guide 106, the rotation axis 107, a tips 105 and the guidance means 104.

In the resting position (FIG. 1), with the trigger 5 inoperative, the pivoted element 102 or square keeps the transmission rod 101 supported on the hammer 6, being a separation space or clearance 100 between the operation end of the valve 12*a* and the stud 58.

The linear guide 106 is slightly inclined, being the tips 105 in a lower plane to that of the inner end of the linear guide 106, being the guidance means placed in the external end of the linear guide or in a point near the same.

Thus, it can be verified that even if the pistol falls to the ground, the stud 58 would never hit the operating end 12*a* of the valve, since the transmission rod 101 blocks said approach movement.

In the firing position (FIG. 2), when the trigger 5 is pulled, the guidance means 104 that is integral to said trigger goes through the linear guide 106 causing the anticlockwise rotation of the square 102 (if the mechanism were on the other side of the pistol would be a clockwise rotation) and drags the rod 101 in the opposite direction to the movement of the trigger releasing the hammer 6 which at this moment by means of its stud 58 can freely impact the operating end of the valve 12*a*.

In this embodiment, the square 102 is in general a modified L-shaped plate, pivoted in its centre, coupled at the end of its smaller arm with the rod 101 and comprising a fork 103 in its biggest arm, with tips 105, with a linear guide 106, designed to receive the guidance means 104 belonging to the trigger mechanism 5.

The comparative exam of the FIGS. 1 and 2 allows seeing the differences of positions of the main elements of the described mechanism, and how the separation space or clearance 100 defined in the first case is a safety factor while the pistol is non-operational or this one is in the prior position to its operation.

The present improvements comprise a second trigger safety mechanism. So, in the case that the trigger 5 could be moved due to the effect of the fall or the hit releasing therefore the rod 101 to the hammer 6, there is provided a catch in the cover of the pistol (not shown in the drawings), so that when the pistol falls to the ground, the trigger 5 is displaced, consequently the cover is also moved in the direction of advance of the trigger, but said cover will be blocked due to the action of said catch with the end 121 of the arm 40. It is achieved by placing the spring 120 connected to said arm and which retards to a minimum the movement of the arm 40 sufficiently in order that the catch of the cover remains blocked by the end 121. In a normal situation when the trigger 5 is pulled, the arm 40 can be steadily moved and can be prevented that the catch of the cover remains blocked by the end 121. That is, when the pistol falls to the ground, the impact in the trigger 5 and its consequent inertial movement is faster than the rotation of the arm 40 and therefore the guide is blocked. This does not happen as the trigger 5 is pulled when normally firing for the reason that the arm 40 which is moved by the spring 120 follows the movement of the trigger when this one releases it after the movement of the snug 55.

The present invention describes improvements on the subject of the Spanish Patent n. 200202704 for "compressed gas operated pistol". The examples here mentioned are not limitative of the present invention, for that reason it will be able to have different applications and/or be adapted, all of them within the scope of the following claims.

The invention claimed is:

1. A Compressed gas operated pistol, of the type that comprises a support casing with a cover, the support casing defining:

a barrel zone that contains a barrel (2) with a rear end facing a chamber, said barrel being able to move and is guided linearly to cause a movement of a rocker in an axial direction;

a trigger zone including a trigger (5) connected to a trigger safety mechanism (101,102); and a stock zone (7) including an ammunition magazine arranged to insert and retain a pellet into said chamber prior to each shot, and a pressurised gas cylinder (10) connected with a valve chamber which, in turn, is connected to said chamber via a valve element pushed by elastic means towards a closed position, said valve element can be instantly moved to an open position by an impact from a hammer (6);

wherein said trigger safety mechanism consists of a pivoted element (102):

in a lower part of the pivoted element there is a shaped fork (103) which is slightly inclined in relation to the horizontal, through of which linear guide (106), in the interior of said fork there is a guidance means (104) linked to the trigger (5), in an upper part of the pivoted element there is an articulated transmission rod (101) that is supported by its other end on the hammer (6), there being a separation space (100) between the hammer (6) and the operation end of the valve (12*a*) when the trigger (5) is in a resting position, and in a point of the surface of the pivoted element (102) there is a rotation axis (107) of said pivoted element to the body of the pistol, so that when the trigger (5) is moved to an active position, the guidance means (104) passes through the interior of the linear guide (106) causing the rotation and rocker movement of said pivoted element (102) by means of its rotation axis (107), so that the pivoted element (102) drags the rod (101) in the opposite direction to the movement of the trigger (5) allowing the hammer (6) to impact the valve.

2. A pistol, in accordance with claim 1, further comprising a second trigger safety mechanism consisting of that in the interior of the cover there is a catch that stops the advance of the cover in the case of an accidental fall by means of the block generated by the end (121) of the arm (40), the movement of said arm (40) being retarded with respect to the trigger (5) due to the action of a spring (120) connected thereof.

3. A pistol, in accordance with claim 1, wherein the pivoted element (102) is a generally modified "L" shaped plate.

* * * * *